US007209088B2

(12) United States Patent
Maruyama et al.

(10) Patent No.: US 7,209,088 B2
(45) Date of Patent: Apr. 24, 2007

(54) FEED ANTENNA INCLUDING DIELECTRIC WAVEGUIDE

(75) Inventors: Masakatsu Maruyama, Kobe (JP); Chitaka Manabe, Kobe (JP); Yoshito Fukumoto, Kobe (JP); Nobuyuki Kawakami, Kobe (JP); Takayuki Hirano, Kobe (JP)

(73) Assignee: Kabushiki Kaisha Kobe Seiko Sho, Hyogo (JP)

( * ) Notice: Subject to any disclaimer, the term of this patent is extended or adjusted under 35 U.S.C. 154(b) by 146 days.

(21) Appl. No.: 11/000,975

(22) Filed: Dec. 2, 2004

(65) Prior Publication Data

US 2006/0050003 A1 Mar. 9, 2006

(30) Foreign Application Priority Data

Dec. 2, 2003 (JP) ..... 2003-402761

(51) Int. Cl.
*H01Q 13/00* (2006.01)

(52) U.S. Cl. ..... 343/772; 343/700 MS

(58) Field of Classification Search ..... 343/772, 343/786, 700 MS
See application file for complete search history.

(56) References Cited

U.S. PATENT DOCUMENTS

| | | | | |
|---|---|---|---|---|
| 5,757,331 | A * | 5/1998 | Yoneyama et al. | 343/783 |
| 5,815,123 | A * | 9/1998 | Uematsu et al. | 343/785 |
| 6,008,771 | A * | 12/1999 | Tanaka et al. | 343/767 |
| 6,104,264 | A * | 8/2000 | Ishikawa et al. | 333/239 |

FOREIGN PATENT DOCUMENTS

| | | |
|---|---|---|
| JP | 06-209210 | 12/1992 |
| JP | 06-209212 | 12/1992 |
| JP | 06-209213 | 12/1992 |
| JP | 06-296105 | 3/1993 |
| JP | 2002-064326 | 8/2000 |
| JP | WO 2004/068628 | 1/2004 |

* cited by examiner

*Primary Examiner*—Hoang V. Nguyen
*Assistant Examiner*—Dieu Hien Duong
(74) *Attorney, Agent, or Firm*—Reed Smith LLP; Stanley P. Fisher, Esq.; Juan Carlos A. Marquez, Esq.

(57) ABSTRACT

A feed antenna includes a pair of conductive members, a dielectric waveguide placed therebetween, a dielectric member that is placed between the conductive members and located close to the dielectric waveguide, and a plurality of dielectric binding sections for binding the dielectric waveguide to the dielectric member. One of the conductive members has a plurality of openings.

23 Claims, 12 Drawing Sheets

FEED ANTENNA INCLUDING DIELECTRIC WAVEGUIDE

BACKGROUND OF THE INVENTION

1. Field of the Invention

The present invention relates to a feed antenna (planar antenna) including a dielectric waveguide. The feed antenna works at high frequencies higher than those of millimeter waves with high efficiency and is small in size and suitable for large-scale manufacture.

2. Description of the Related Art

Among antennas working at high frequencies higher than those of submillimeter waves, known is a dielectric leaky-wave antenna which includes a dielectric waveguide including a grounding conductor and a dielectric plate placed thereon, metal strips arranged on the dielectric plate at predetermined intervals, and transmission lines from which electromagnetic waves leak. When such a dielectric leaky-wave antenna has an array structure in which a plurality of slim transmission lines are arranged in parallel, wide-band plane waves of which the planes are parallel to each other must be fed in the direction in which the transmission lines are arranged.

Known dielectric lenses and parabolic reflectors used to generate such wide-band plane waves are large in size and are not therefore suitable for small-sized systems such as millimeter-wave radar systems for on-vehicle use.

Spaces or dielectric members with different dielectric constants must be three-dimensionally arranged to in dielectric waveguides or metal plates or metal strips must be placed on side faces of dielectric waveguides in the longitudinal direction. Therefore, there is a problem in that known feed antennas cannot be manufactured with low cost and are not suitable for large-scale manufacture because of their complicated structures.

SUMMARY OF THE INVENTION

The present invention has been made to solve the above problem. It is an object of the present invention to provide a feed antenna (planar antenna) which includes a dielectric waveguide, which works at high frequencies higher than those of submillimeter waves with high efficiency, and which is small in size and suitable for large-scale manufacture.

In order to achieve the above object, a feed antenna of the present invention includes a pair of conductive members, a dielectric waveguide placed therebetween, a dielectric member that is placed between the conductive members and located close to the dielectric waveguide, and a plurality of dielectric binding sections for binding the dielectric waveguide to the dielectric member. One of the conductive members has a plurality of openings.

The feed antenna of the present invention principally has the above configuration and may have configurations described below.

The feed antenna may further include a first section that is present between the first and second conductive members and located on the side of the dielectric waveguide opposite to the dielectric member and/or second sections that are each present between the dielectric binding sections. The first section and/or the second sections preferably contain a dielectric material having a dielectric constant less than that of the dielectric member.

In the feed antenna, the dielectric waveguide preferably has variation sections, arranged in the longitudinal direction of the dielectric waveguide, having dielectric constants different from those of other sections of the dielectric waveguide.

In the feed antenna, the dielectric constant of the dielectric waveguide preferably varies in the longitudinal direction thereof.

In the feed antenna, the dielectric constant of the dielectric waveguide preferably varies in the longitudinal direction thereof with the same periodicity as that of intervals at which the dielectric binding sections are arranged.

In the feed antenna, the variation sections are preferably inclined to the longitudinal direction of the dielectric waveguide.

In the feed antenna, an end portion of each variation section that is close to one of the dielectric binding sections is preferably spaced from an end portion of the dielectric binding section that is close to the variation section in the longitudinal direction of the dielectric waveguide at a distance equal to one fourth of the wavelength of feed signals transmitted to the dielectric waveguide.

In the feed antenna, the dielectric binding sections are preferably arranged at intervals equal to an integral multiple of the wavelength of feed signals transmitted to the dielectric waveguide.

In the feed antenna, the dielectric member preferably includes variation sections, arranged in the direction substantially perpendicularly to the dielectric waveguide, having dielectric constants different from those of other sections of the dielectric member.

In the feed antenna, the dielectric constant of the dielectric member preferably varies in the direction substantially perpendicular to the dielectric waveguide.

In the feed antenna, the dielectric constant of the dielectric waveguide preferably varies in the longitudinal direction thereof with the same periodicity as that of intervals at which the openings are arranged.

In the feed antenna, the variation sections of the dielectric member are preferably inclined to the direction substantially perpendicular to the dielectric waveguide.

In the feed antenna, an end portion of each variation section of the dielectric member that is close to one of the openings is preferably spaced from an end portion of the opening that is far from the variation section at a distance equal to one fourth of the wavelength of feed signals transmitted from the dielectric binding sections to the dielectric waveguide.

In the feed antenna, the openings of the dielectric member are preferably arranged at intervals equal to an integral multiple of the wavelength of feed signals transmitted from the dielectric binding sections to the dielectric member.

In the feed antenna, the dielectric waveguide, the dielectric member, and the dielectric binding sections preferably contain substantially the same dielectric material and have different porosities.

The feed antenna of the present invention can function as a small-sized planar antenna with high efficiency because the feed antenna includes the conductive members; the dielectric waveguide for feeding; the dielectric binding sections for splitting signals transmitted from the dielectric waveguide to create plane waves; and the dielectric member, having the openings for radiating the plane waves in free space, for propagating the plane waves.

The dielectric constant of the dielectric member placed between the conductive members varies so as to form a two-dimensional pattern and the dielectric member is made of a porous material. The dielectric member can be prepared by a patterning process in such a manner that the distribution of the dielectric constant is controlled.

The feed antenna of the present invention works at high frequencies with high efficiency and is small in size and suitable for large scale manufacture. The feed antenna has superior properties such as a property of splitting feed signals at the dielectric binding sections with high efficiency. If reflections occur at an impedance mismatch, reflected waves are created, whereby serious reflection can be prevented from occurring, that is, reflection properties of the feed antenna can be prevented from being deteriorated.

DESCRIPTION OF THE PREFERRED EMBODIMENTS

A feed antenna including a dielectric waveguide according to an embodiment of the present invention will now be described.

Figure 1:
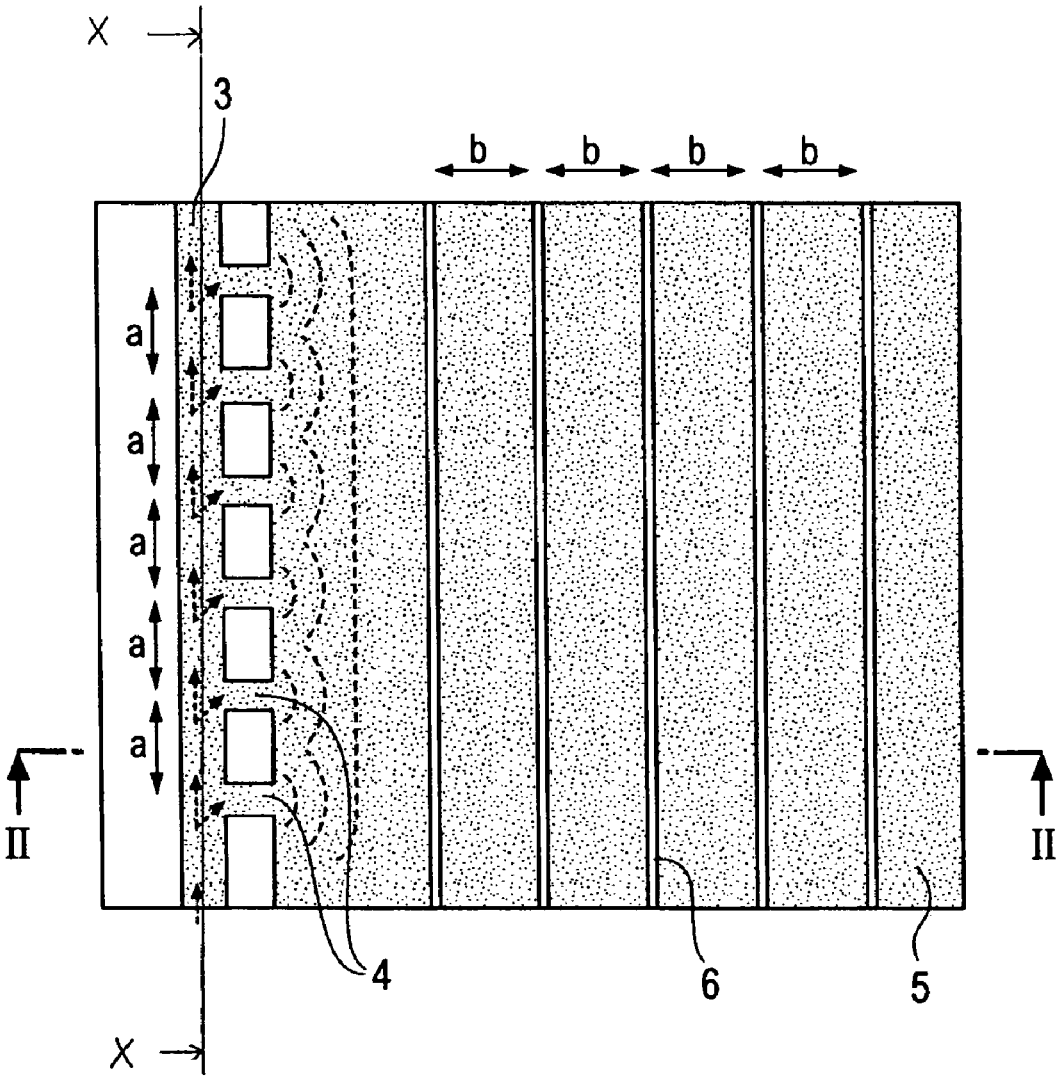
FIG. 1 is a plan view showing a feed antenna including a dielectric waveguide according to an embodiment of the present invention.
Figure 2:
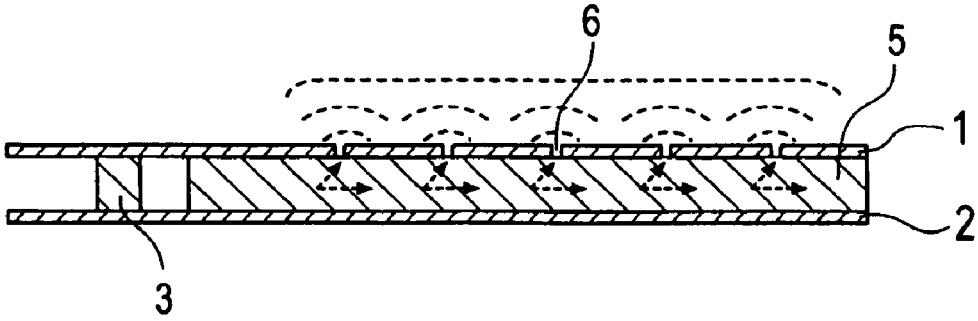
FIG. 2 is a sectional view taken along the line II—II of FIG. 1.

FIGS. 1 and 2 show a feed antenna including a dielectric waveguide according to an embodiment of the present invention. FIG. 1 is a plan view showing the feed antenna and FIG. 2 is a sectional view showing the feed antenna taken along the line II—II of FIG. 1. With reference to FIGS. 1 and 2, the feed antenna includes a first conductive member 1, a second conductive member 2, a dielectric waveguide 3 placed therebetween, a dielectric member 5 (hereinafter referred to as a dielectric layer or a dielectric plate in some cases) that is placed between the first and second conductive members 1 and 2 and placed close to the dielectric waveguide 3, and a plurality of dielectric binding sections 4 for binding the dielectric waveguide 3 to the dielectric member 5. The first conductive member 1 has a plurality of openings 6, which may be referred to as slots.

In particular, the first and second conductive members 1 and 2 have a flat plate shape and are parallel to each other; therefore, they may be referred to as dielectric flat plates. The dielectric member 5 has a flat plate shape. The openings 6 are arranged in the first conductive member 1 at predetermined intervals b. The first and second conductive members 1 and 2 need not necessarily have such a flat plate shape and may have another shape depending on applications and requirements of the feed antenna.

Figure 19:
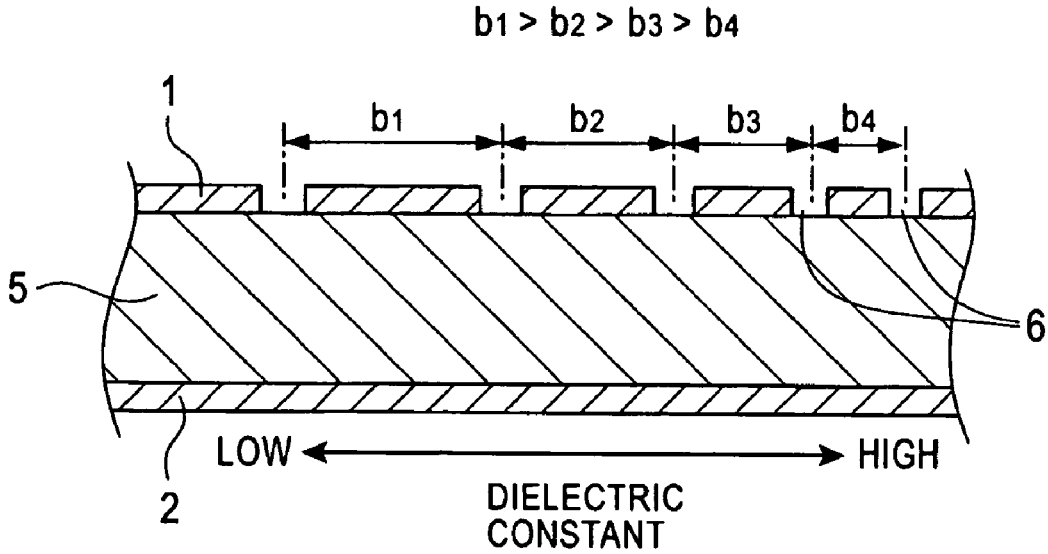
FIG. 19 is a sectional view showing another configuration of the dielectric member of the feed antenna.

The intervals b of the openings 6 are the same as shown in FIG. 1 but need not be the same. The intervals b may be different from each other depending on applications and requirements of the feed antenna. For example, as shown in FIG. 19, the intervals b are different from each other as follows: b1>b2>b3>b4. Therefore, the dielectric constant increases stepwise from the left side to right side of the dielectric member 5 as shown in FIG. 19.

Figure 20:
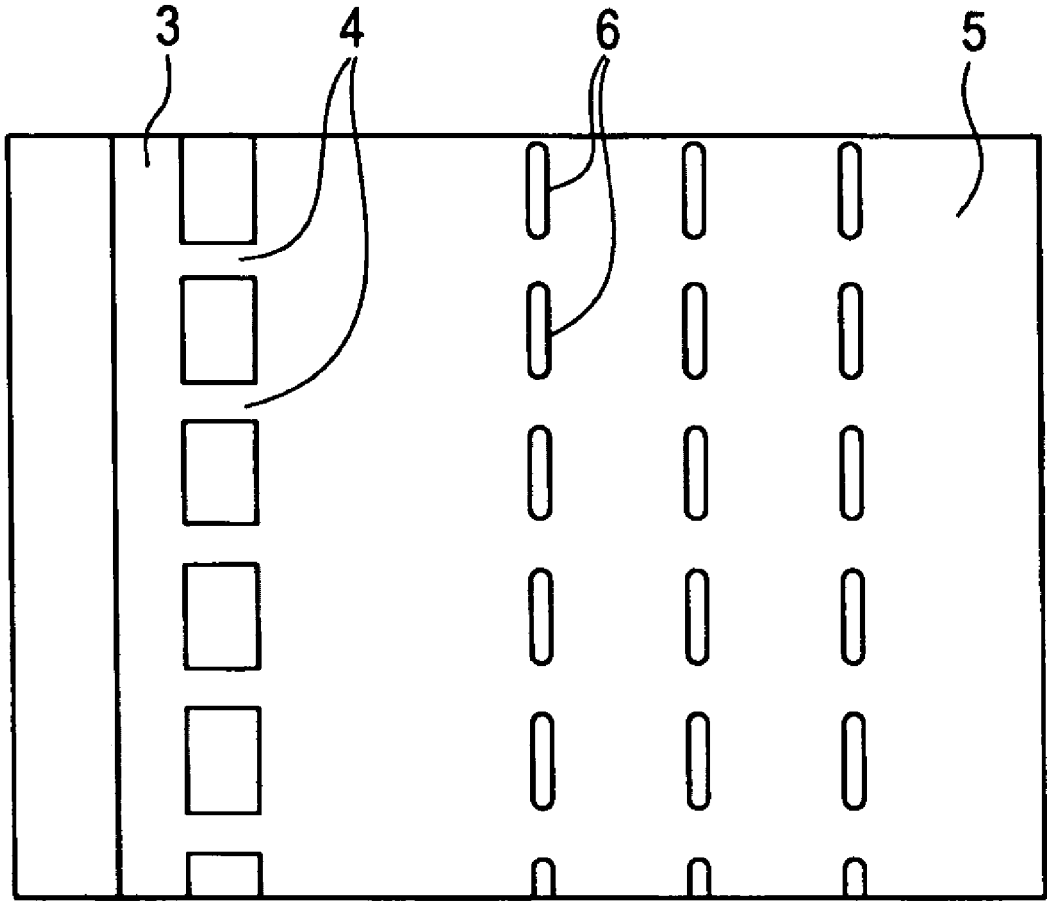
FIG. 20 is a plan view showing the feed antenna having another configuration.

The openings 6 have a slit shape and extend from an end of the dielectric member 5 to the opposite end in the lateral direction of the dielectric member 5 as shown in FIG. 1, that is, the openings 6 extend vertically in the figure. However, the openings 6 need not have such a configuration and may have another configuration depending on applications and requirements of the feed antenna. The openings 6 may be, for example, slits or holes arranged in the lateral and longitudinal directions of the dielectric member 5 as shown in FIG. 20. Furthermore, the openings 6 may have another shape such as a linear shape, a rectangular shape, or an elliptic shape when viewed from above.

The dielectric binding sections 4 arranged at predetermined intervals a. The feed antenna may further include a first section that is present between the first and second conductive members 1 and 2 and located on the side of the dielectric waveguide 3 opposite to the dielectric member 5 and/or second sections that are each present between the dielectric binding sections 4 and represented by the white rectangles in FIGS. 1 and 2. The first section and/or the second sections may contain air or a dielectric substance having a small dielectric constant. Alternatively, the first section and/or the second sections may be spaces. The white rectangles shown in FIGS. 1 and 2 need not be covered with the first and second conductive members 1 and 2.

Figure 18:
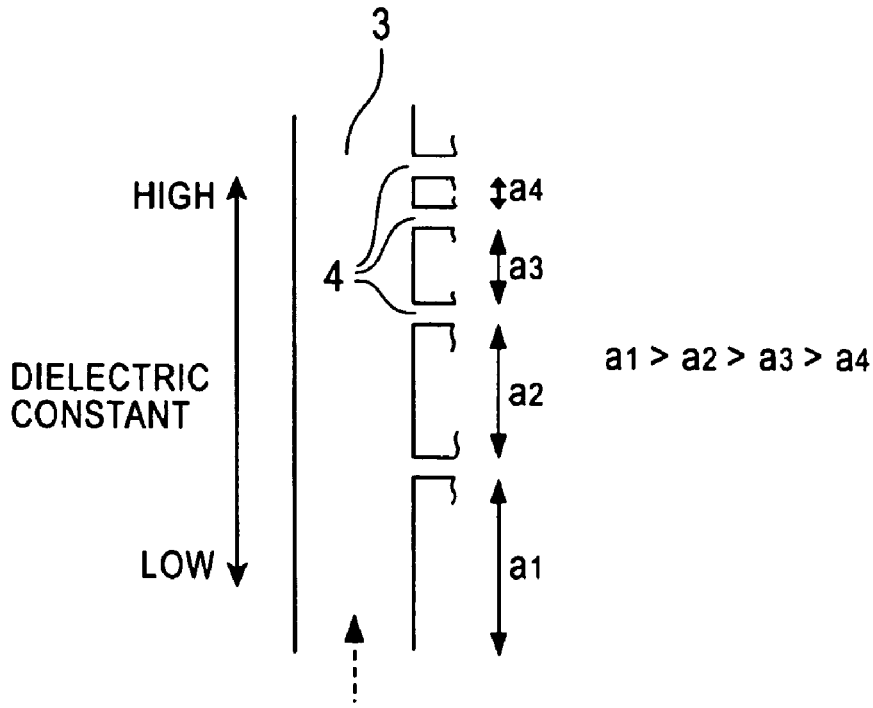
FIG. 18 is a plan view showing another configuration of the dielectric member of the feed antenna.

The intervals a of the dielectric binding sections 4 are the same as shown in FIG. 1 but need not be the same. The intervals a may be different from each other depending on applications and requirements of the feed antenna. For example, as shown in FIG. 18, the intervals a are different from each other as follows: a1>a2>a3>a4. Therefore, the dielectric constant increases stepwise in the bottom-to-top direction of the dielectric binding sections 4 as shown in FIG. 18.

FIG. 1 shows the openings 6 but does not show the first conductive member 1 shown in FIG. 2. This can be applied to FIGS. 3, 4, and 6 described below.

With reference to FIGS. 1 and 2, dotted arrows indicate feed signals. As shown in FIG. 1, the feed signals are fed from a lower left section of the feed antenna and then split with the dielectric binding sections 4 while they are transmitted through the dielectric waveguide 3. The split signals are transmitted to the dielectric member 5. The feed signals transmitted through the dielectric binding sections 4 to the dielectric member 5 are formed into radio waves indicated by dotted lines having an arc shape and the radio waves are formed into a plane wave indicated by a dotted line that is substantially straight and is located at the right side of the dotted arc lines. The plane wave is transmitted from the left side of the feed antenna to the right side as shown in FIGS. 1 and 2.

With reference to FIG. 2, the feed signals transmitted through the dielectric member 5 are radiated in free space through the openings 6. In this stage, the feed signals radiated through the openings 6 are formed into radio waves indicated by dotted lines having an arc shape and the radio waves are formed into a plane wave indicated by a dotted line that is substantially straight and is located at the right side of the dotted arc lines. The plane wave is radiated from the feed antenna in the upper direction as shown in FIG. 2.

The dielectric member 5 has a configuration in which the dielectric constant varies so as to form a two-dimensional pattern and is made of a porous material described below. The dielectric member 5 is prepared by a patterning process in such a manner that the distribution of the dielectric constant is controlled.

The feed antenna has the configuration described above, that is, the feed antenna includes the dielectric waveguide 3 acting as a feeder. Therefore, the feed antenna has low conductor loss and is simple and small in size.

Other configurations of the feed antenna will now be described.

Figure 3:
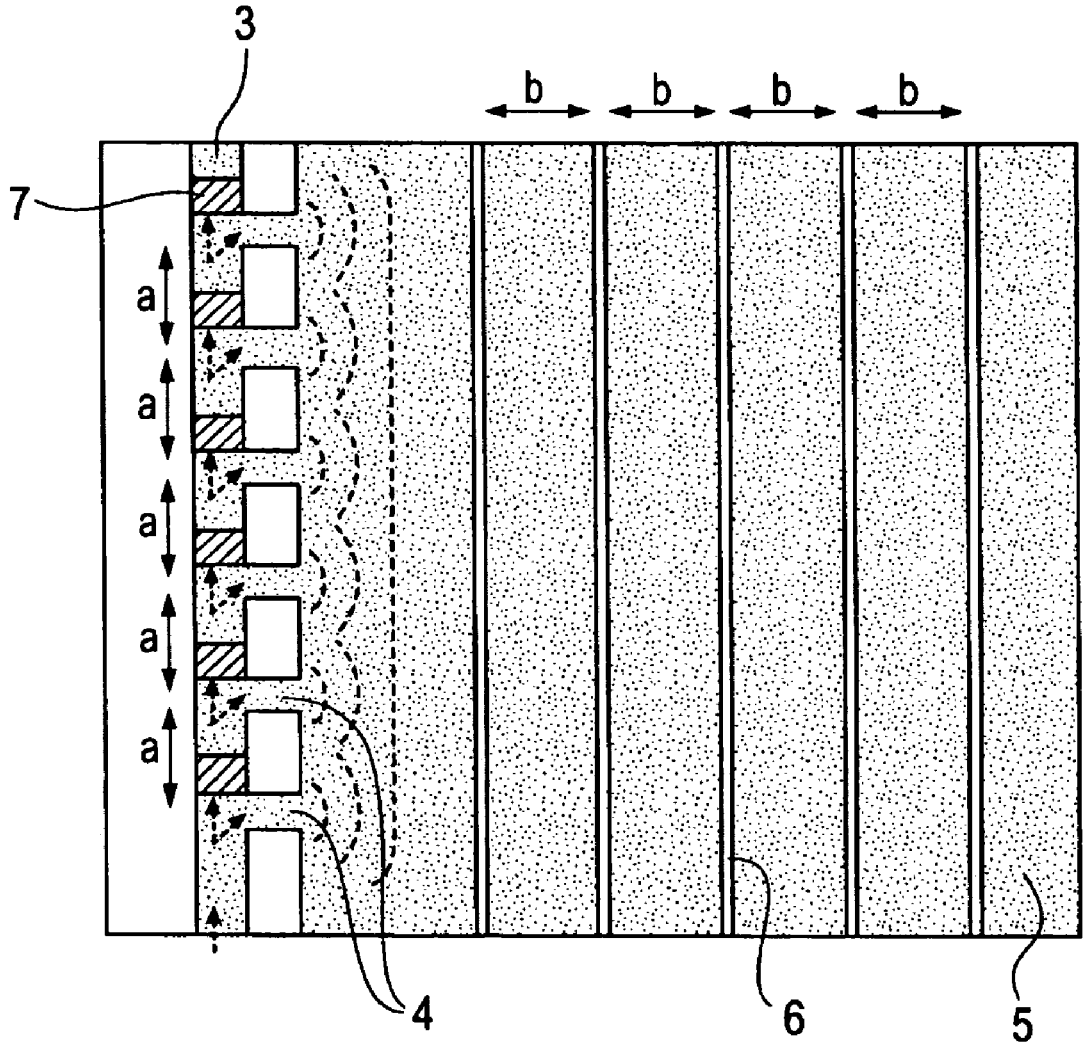
FIG. 3 is a plan view showing another configuration of the feed antenna.

FIG. 3 is a plan view showing the feed signal. The dielectric constant of the dielectric waveguide 3 is varied so as to adjust the degree of coupling at the dielectric binding sections 4. With reference to FIG. 3, the dielectric waveguide 3 has variation sections 7 shown shaded in the figure. The variation sections 7 have dielectric constants different from those of other sections of the dielectric waveguide 3 and are arranged at the same intervals as those of the dielectric binding sections 4 in the longitudinal direction of the dielectric waveguide 3. Therefore, the dielectric constant of the dielectric waveguide 3 varies with the same periodicity as that of the intervals of the dielectric binding sections 4 in the longitudinal direction of the dielectric waveguide 3.

The variation sections 7 have dielectric constants different from those of other sections of the dielectric waveguide 3 as described above and may have dielectric constants greater than or less than those of other sections of the dielectric waveguide 3. A large difference in dielectric constant between the variation sections 7 and other sections of the dielectric waveguide 3, that is, a large discontinuity in dielectric constant therebetween, allows impedance mismatch to occur, thereby splitting much feed signals at the dielectric binding sections 4 to adjust the splitting ratio in a wide range.

If the dielectric waveguide 3 does not have the variation sections 7, securely partitioned, arranged in the longitudinal direction thereof and the dielectric constant of the dielectric waveguide 3 varies in the longitudinal direction thereof, the same advantage as that of the configuration shown in FIG. 3 can be achieved.

Figure 11:
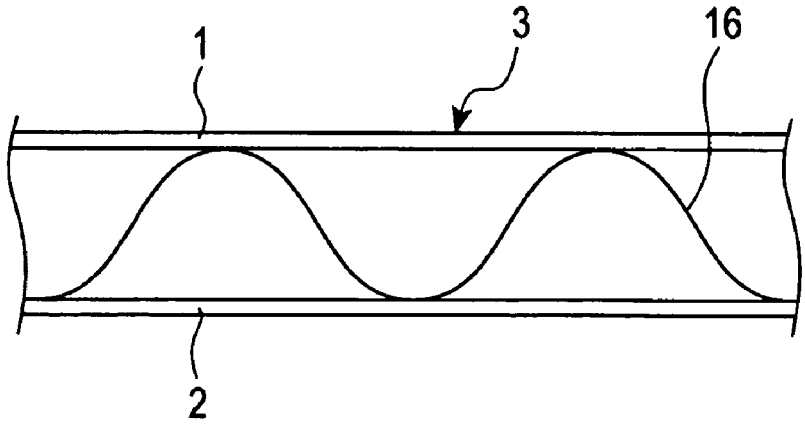
FIG. 11 is a schematic view showing a dielectric waveguide of which the dielectric constant varies in the longitudinal direction of the dielectric waveguide.
Figure 12:
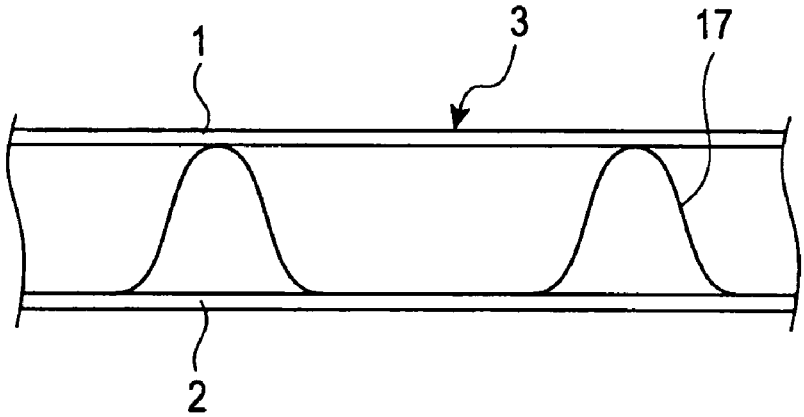
FIG. 12 is a schematic view showing another dielectric waveguide of which the dielectric constant varies in the longitudinal direction of the dielectric waveguide.
Figure 13:
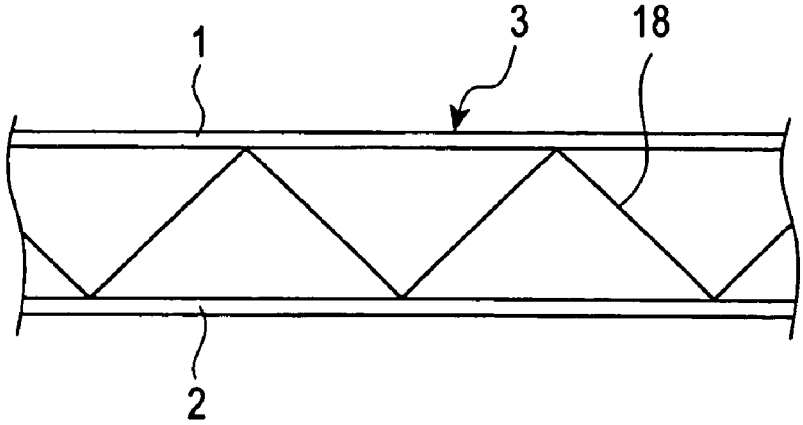
FIG. 13 is a schematic view showing another dielectric waveguide of which the dielectric constant varies in the longitudinal direction of the dielectric waveguide.

The dielectric constant of the dielectric waveguide 3 may be varied continuously or stepwise as shown in FIG. 11, 12, or 13. FIG. 11 shows the dielectric constant thereof that varies as a sine curve represented by reference numeral 16. FIG. 12 shows the dielectric constant thereof that varies as a curve represented by reference numeral 17, and FIG. 13 shows the dielectric constant thereof that varies as a polygonal line represented by reference numeral 18. Such a configuration in which there are no securely partitioned sections having dielectric constants different from those of other sections and in which the dielectric constant varies can be achieved by varying the porosity of a porous material contained in the dielectric waveguide 3 gradually or stepwise as described below.

When the dielectric constant of the dielectric waveguide 3 varies in the direction perpendicular to the direction in which the feed signals are transmitted as shown in FIG. 3, reflections can occur at an impedance mismatch to create reflected waves, thereby causing serious reflection.

In order to cope with such a problem, the variation sections 7 may be inclined to the longitudinal direction of the dielectric waveguide 3.

Figure 4:
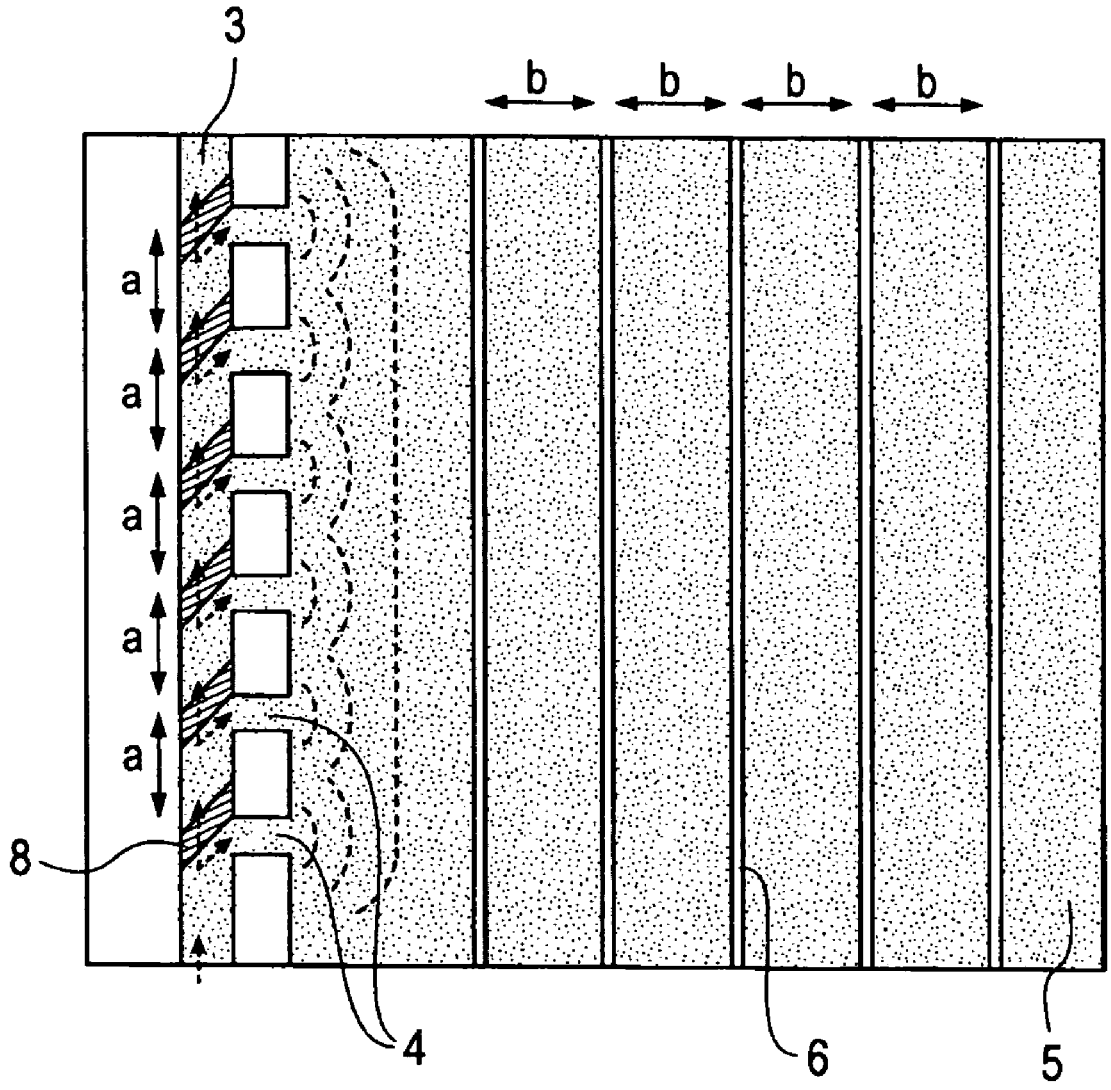
FIG. 4 is a plan view showing another configuration of the feed antenna.
Figure 5:
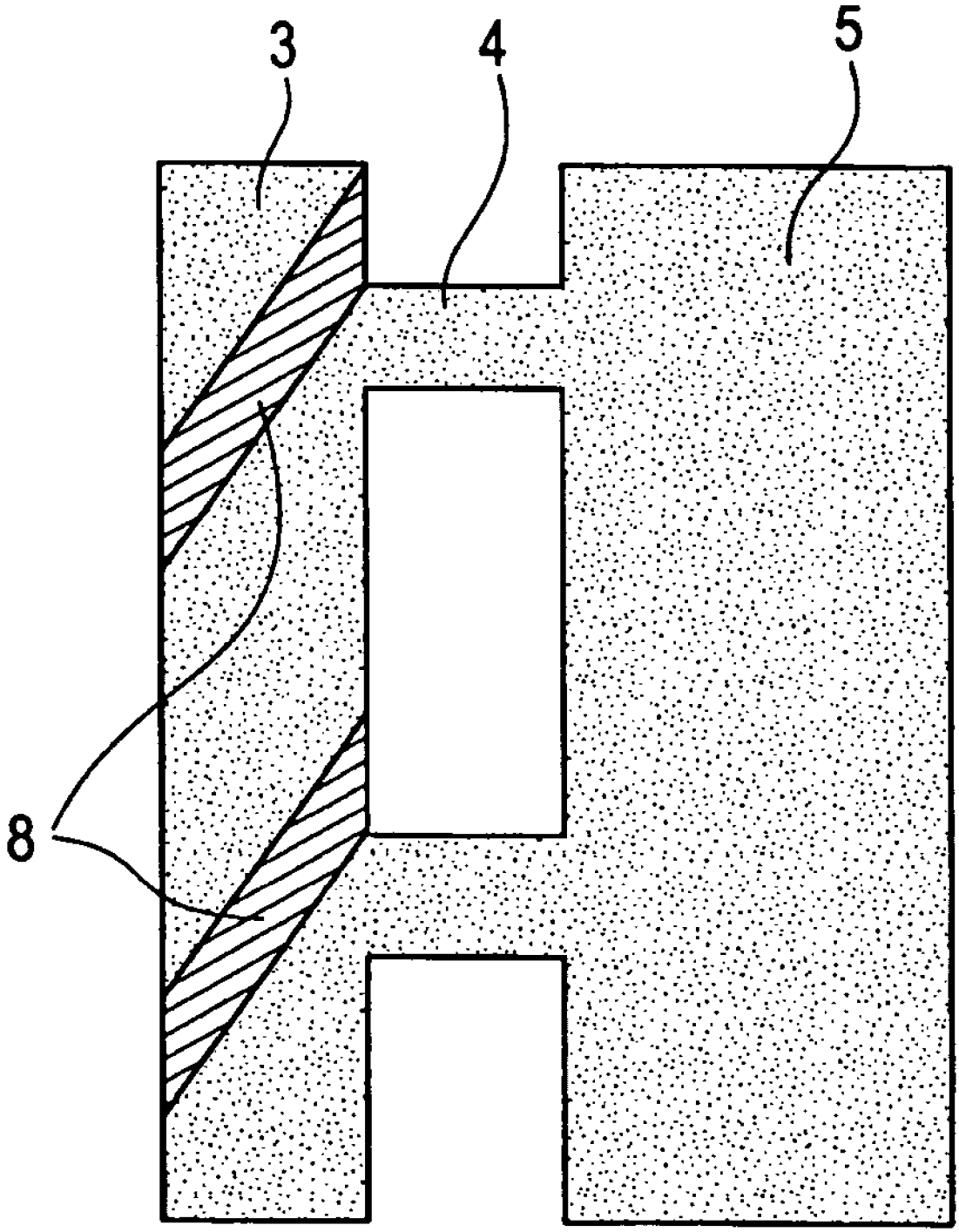
FIG. 5 is a partly enlarged view of FIG. 4.

FIG. 4 is a plan view showing the feed antenna and FIG. 5 is a partly enlarged view of FIG. 4. As shown in FIGS. 4 and 5, the dielectric waveguide 3 may have variation sections 8 shown shaded in the figures. The variation sections 8 have dielectric constants different from those of other sections of the dielectric waveguide 3 and are inclined to the propagation direction of feed signals when viewed from above. That is, the variation sections 8 are asymmetric with respect to the propagation direction thereof.

Figure 14:
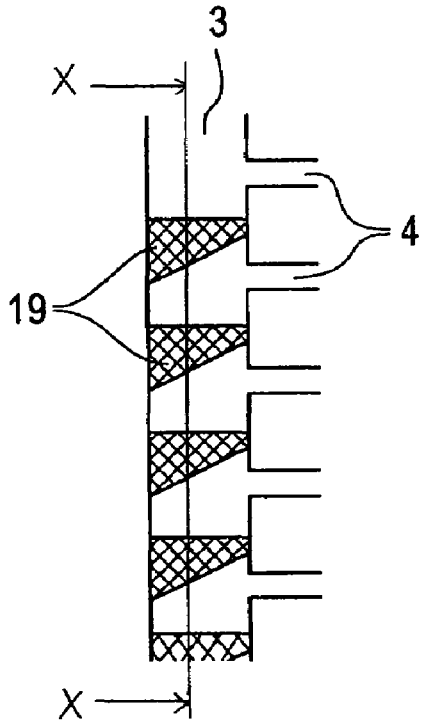
FIG. 14 is a plan view showing a configuration of the dielectric waveguide of the feed antenna.
Figure 15:
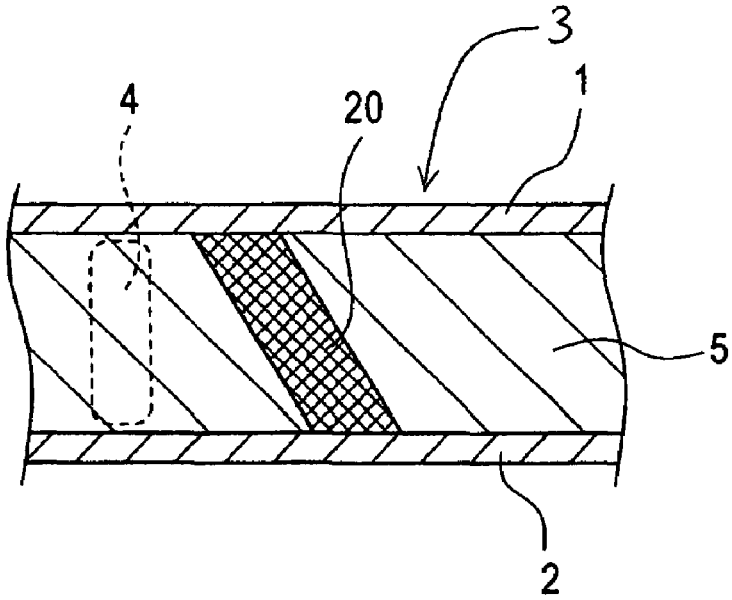
FIG. 15 is a sectional view showing another configuration of the dielectric waveguide of the feed antenna.
Figure 16:
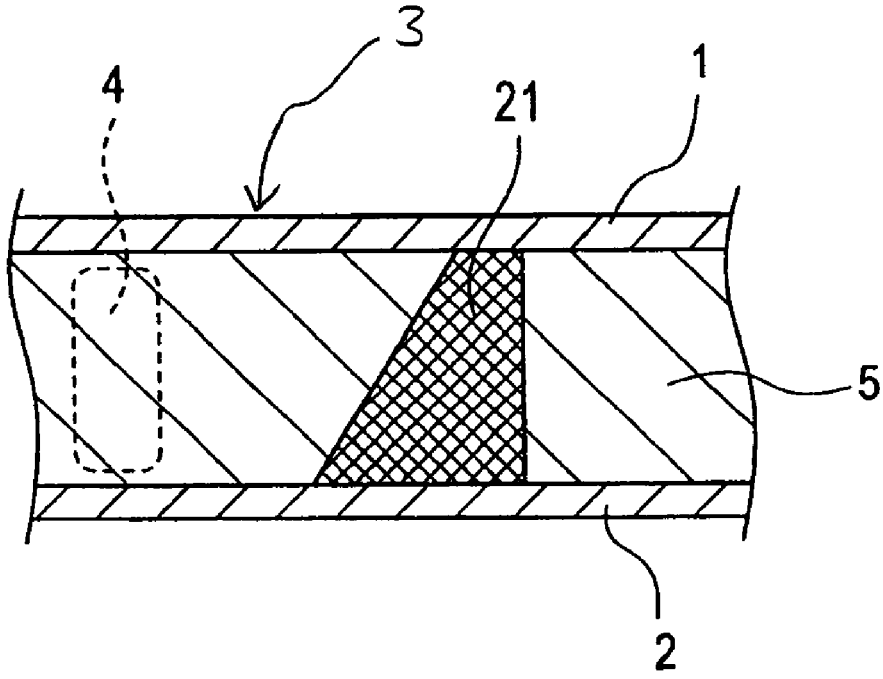
FIG. 16 is a sectional view showing another configuration of the dielectric waveguide of the feed antenna.

FIG. 14 is a plan view showing the feed antenna having another configuration. The dielectric waveguide 3 may have variation sections 19, shown in FIG. 14, having dielectric constants different from those of other sections. The shape of the variation sections 19 is different from that of the variation sections described above. Alternatively, the dielectric waveguide 3 may have variation sections 20 shown in FIG. 15 in cross section or variation sections 21 shown in FIG. 16 in cross section. The variation sections 20 or 21 have dielectric constants different from those of other sections and are inclined to the thickness direction of the dielectric waveguide 3 and are inclined to the thickness direction of the dielectric waveguide 3.

According to the above configurations, feed signals can be prevented from being reflected at an impedance discontinuity on which the signals are concentrated. Therefore, the feed antenna has improved reflection properties.

Figure 6:
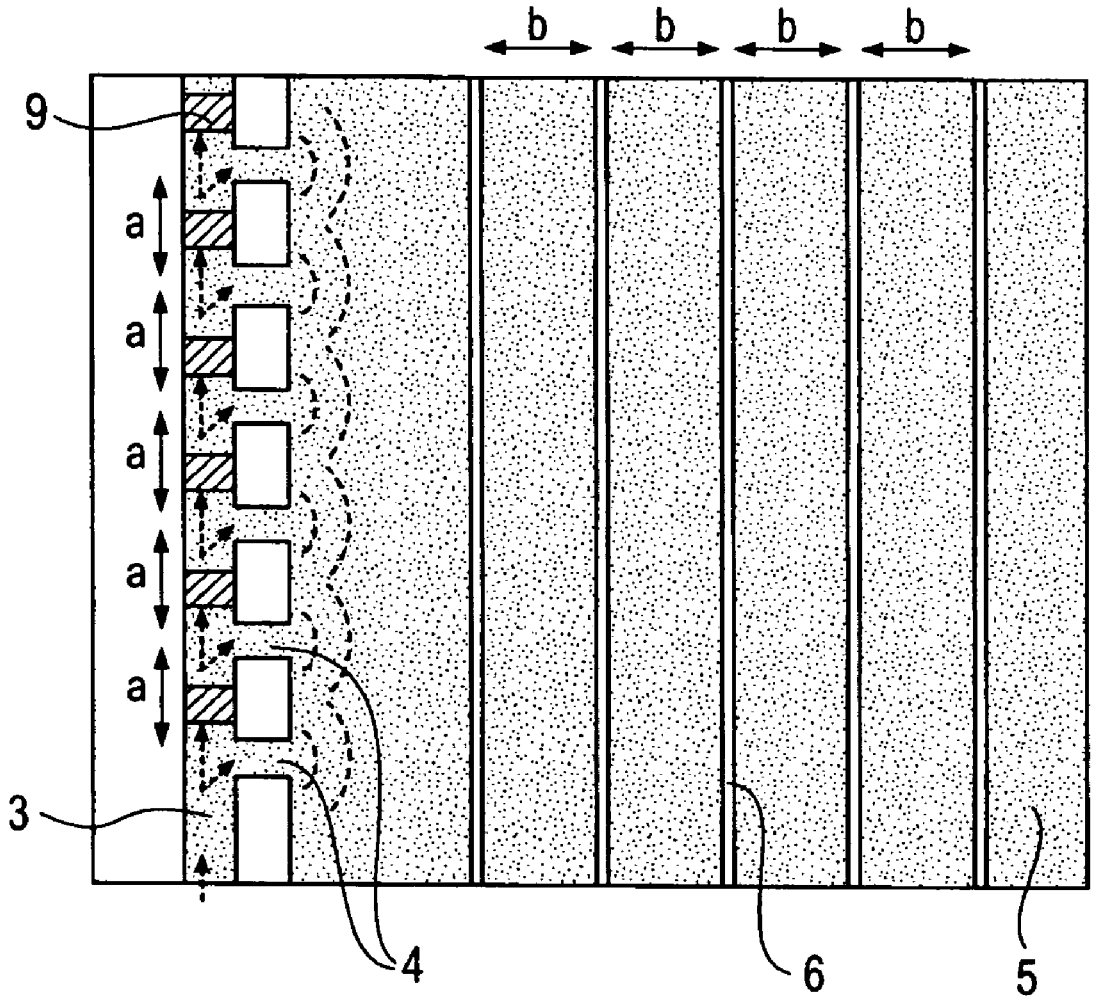
FIG. 6 is a plan view showing another configuration of the feed antenna.
Figure 7:
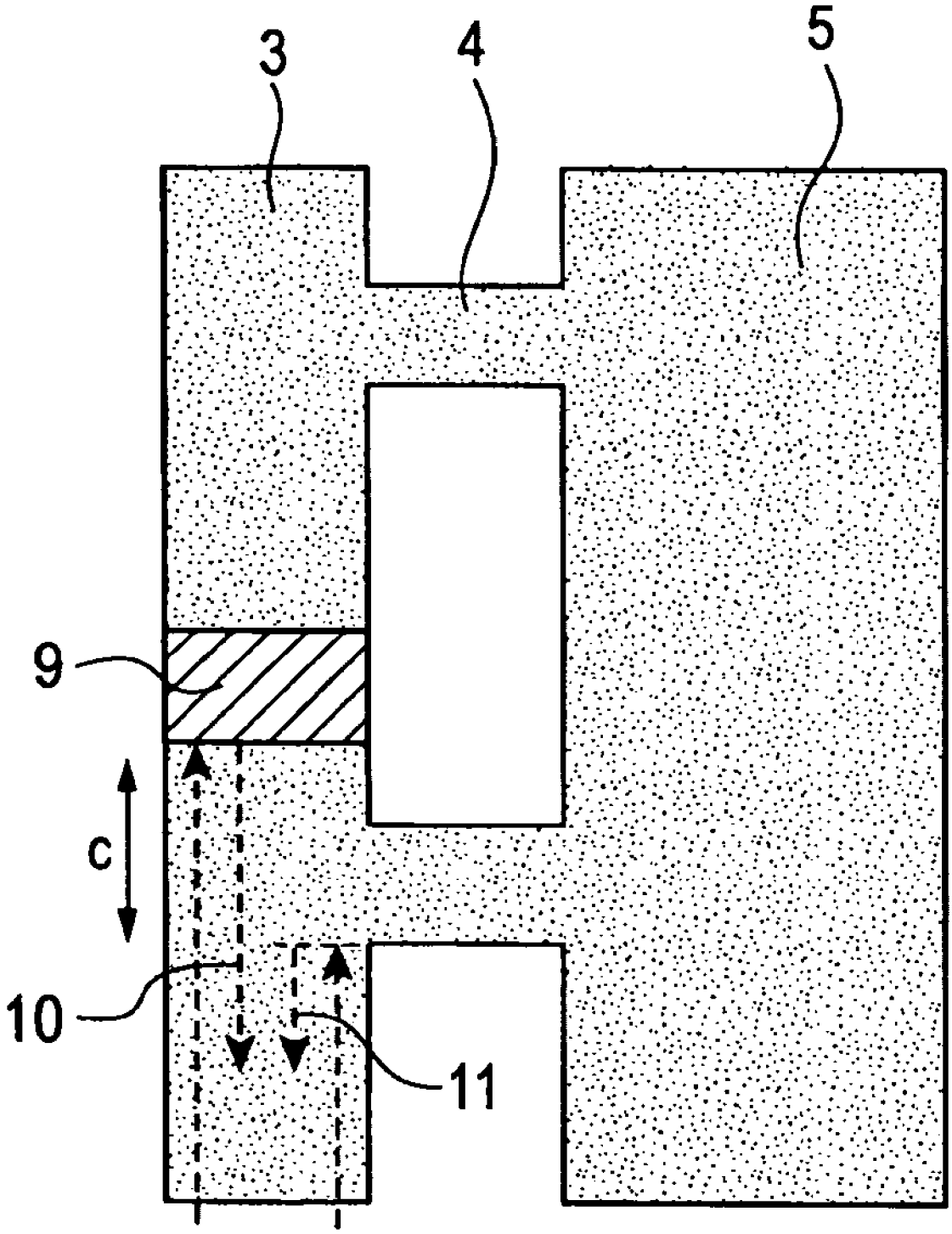
FIG. 7 is a partly enlarged view of FIG. 6.

FIG. 6 is a plan view showing the feed antenna and FIG. 7 is partly enlarged view of FIG. 7. In the feed antenna, an end portion of each variation section 9 that is close to one of the dielectric binding sections 4 is spaced from an end portion of the dielectric binding section 4 that is close to the variation section 9 at a distance equal to one fourth of the wavelength of feed signals, the distance being represented by c. The variation sections 9 have dielectric constants different from those of other sections of the dielectric waveguide 3 and may have dielectric constants, for example, less than those of other sections of the dielectric waveguide 3. A path difference between a first reflection signal 10 reflected by each dielectric binding section 4 and a second reflection signal 11 created at each variation section 9 is equal to one half of the wavelength of these reflection signals, which have phases opposite to each other. The reflection signals are therefore offset each other, that is, the reflection signals disappear.

In the configurations shown in FIGS. 1 to 7, since the intervals a of the dielectric binding sections 4 are equal to an integral multiple of the wavelength of the feed signals propagated through the dielectric waveguide 3, the feed signals are split with the dielectric binding sections 4 and then propagated to the first and second conductive members 1 and 2 in such a manner that the feed signals have the same phase, thereby efficiently forming a plane wave parallel to the feed antenna.

Other configurations of the feed antenna are described below. In the configurations, the dielectric member 5 has variation sections for adjusting the degree of coupling of feed signals, propagated through the dielectric member 5, at the openings 6. The variation sections have dielectric constants different from those of other sections of the dielectric member 5 and are arranged in the direction substantially perpendicular to the dielectric waveguide 3.

In the configurations, the dielectric member 5 as well as the dielectric waveguide 3 need not have any variation sections securely partitioned and the dielectric constant of the dielectric member 5 may vary in the direction substantially perpendicular to the dielectric waveguide 3, as shown in FIGS. 11 to 13.

Figure 8:
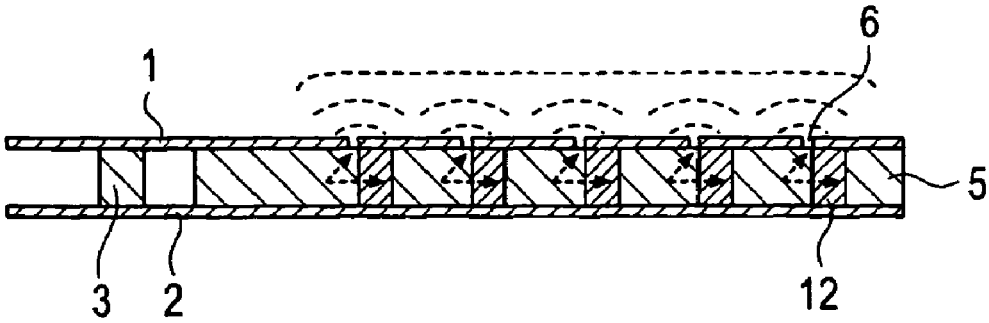
FIG. 8 is a sectional view showing another configuration of the feed antenna.

FIG. 8 is a sectional view showing the feed antenna in which the dielectric member 5 has variation sections 12, shown shaded in the figure, securely partitioned. The variation sections 12 are arranged in the direction substantially perpendicular to the dielectric waveguide 3 at the same intervals as that of the openings 6. The dielectric constant of the dielectric member 5 varies with the same periodicity as that of the intervals b of the openings 6. The variation sections 12 have dielectric constants different from those of other sections of the dielectric member 5 and may have dielectric constants less than those of other sections of the dielectric member 5. A large difference in dielectric constant between the variation sections 12 and other sections of the dielectric waveguide 3, that is, a large discontinuity in dielectric constant between therebetween, allows impedance mismatch to occur, thereby splitting much feed signals at the dielectric binding sections 4 to adjust the splitting ratio in a wide range.

In the above configuration, reflections can occur at an impedance mismatch to create reflected waves to cause serious reflection, as described for the dielectric waveguide 3 above. In order to cope with such a problem, the dielectric member 5 may have variation sections arranged in such a manner that an end portion of each variation section that is close to one of the openings 6 is spaced from an end portion of the opening 6 that is far from the variation section at a distance equal to one fourth of the wavelength of feed signals propagated through the dielectric binding sections 4.

Figure 9:
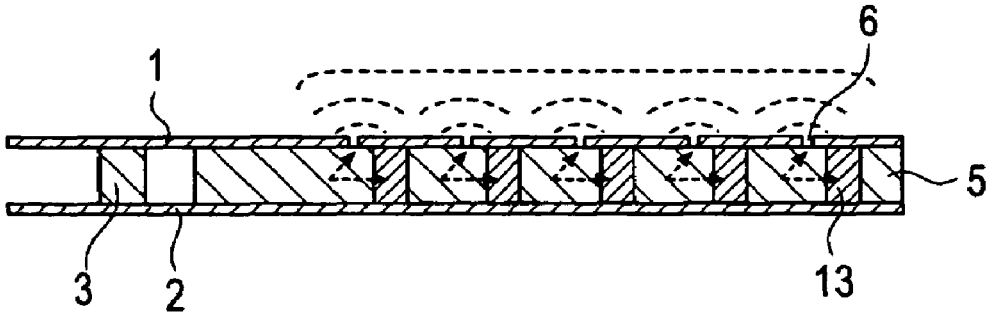
FIG. 9 is a sectional view showing another configuration of the feed antenna.
Figure 10:
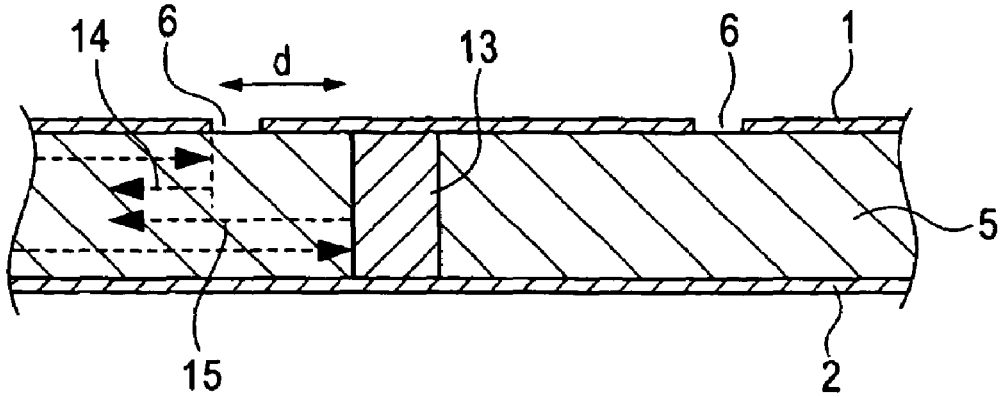
FIG. 10 is a partly enlarged view of FIG. 9.

In particular, as shown in FIG. 9 or 10, the dielectric member 5 has variation sections 13. An end portion of each variation section 13 that is close to one of the openings 6 is spaced from an end portion of the opening 6 that is far from the variation section 13 at a distance equal to one fourth of the wavelength of the feed signals, the distance being represented by d. The variation sections 13 have dielectric constants different from those of other sections of the dielectric member 5 and may have dielectric constants less than those of other sections of the dielectric member 5. FIG. 9 is a sectional view showing the feed antenna and FIG. 10 is a partly enlarged view of FIG. 9.

In the above configuration, a path difference between a first reflection signal 14 reflected by each opening 6 and a second reflection signal 15 created at each variation section 13 is equal to one half of the wavelength of these reflection signals. The reflection signals have phases opposite to each other and are therefore offset each other, that is, the reflection signals disappear.

Figure 17:
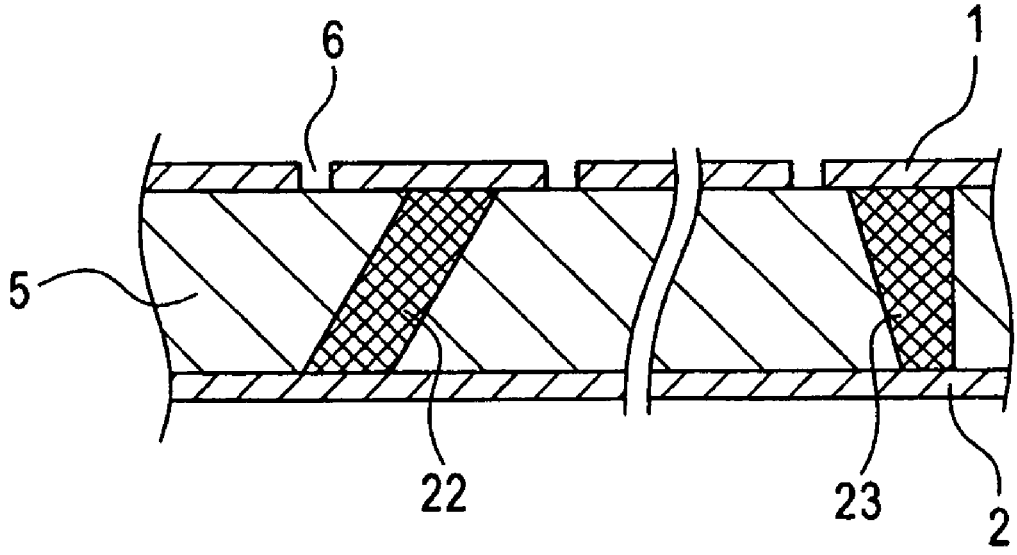
FIG. 17 is a sectional view showing a configuration of the dielectric member of the feed antenna.

Alternatively, as shown in FIG. 17, the dielectric member 5 may have variation sections 22, shown shade in the figure, having dielectric constants different from those of other sections of the dielectric member 5. FIG. 17 is a sectional view showing the dielectric member 5. The variation sections 22 are inclined to the direction substantially perpendicular to the upper and lower faces of the dielectric member 5, that is, the thickness direction of the dielectric member 5.

In this configuration, the intervals b of the openings 6 are equal to an integral multiple of the wavelength of the feed signals propagated through the dielectric binding sections 4; hence, the feed signals are split with the openings 6 and then radiated in free space in such a manner that the feed signals have the same phase, thereby efficiently radiating the feed signals from the feed antenna.

A dielectric material for forming a dielectric layer used for manufacturing the feed antenna is preferably porous. Such a porous dielectric material and a method for manufacturing the material are disclosed in PCT No. WO2004/068628A1. The dielectric layer is prepared using the porous dielectric material and then processed into a dielectric waveguide 3, a dielectric member 5, and dielectric binding sections 4. That is, the dielectric waveguide 3, the dielectric member 5, and the dielectric binding sections 4 are made of the same material. The porosities of those portions are controlled to adjust their dielectric constants. The variation sections 7, 8, 9, 12, 13, 19, 20, 21, 22, and 23 having dielectric constants different from those of other sections of the dielectric waveguide 3 can be controlled to have dielectric constants less or greater than the dielectric constant of the dielectric waveguide 3 and that of dielectric member 5 by allowing these variation sections to have porosities less or greater than the porosity of the dielectric waveguide 3 and that of dielectric member 5.

An increase in the porosity of the porous dielectric material allows the relative dielectric constant of the material (that is, the dielectric layer) to increase close to 1.00. That is, when the porous dielectric material has high porosity, the dielectric layer has very low relative dielectric constant and dielectric loss. When the porous material has a porosity close to 100%, the dielectric layer has properties, such as a relative dielectric constant and dielectric loss, extremely close to those of air. This allows high-frequency signals to be transmitted with high efficiency, that is, low loss. Furthermore, desired dielectric constants can be achieved by adjusting the porosity of the porous dielectric material to an arbitrary value; hence, the degree of design freedom is high.

The dielectric constant may be controlled by varying the porosity of the porous dielectric material continuously or stepwise so as to create the sine curve represented by reference numeral 16, the curve represented by reference numeral 17, or the polygonal line represented by reference numeral 18 as shown in FIG. 11, 12, or 13, respectively.

The dielectric layer has portions having dielectric constants different from those of other portions. Since the porous dielectric material is employed, the dielectric constants can be freely controlled and the pattern of the portions can be freely designed. Known feed antennas have cavities containing air; however, the feed antenna of the present invention does not such cavities and the dielectric layer is made of the porous dielectric material of which propagating properties are not deteriorated; hence, the feed antenna has high physical strength.

A method for manufacturing the feed antenna will now be described, the feed antenna being manufactured using the dielectric layer made of the porous dielectric material. The outline of the method is as follows: the dielectric layer is formed on the first or second conductive member 1 or 2 using the dielectric material; exposed to light, a beam, or steam; and then made porous.

The manufacturing method is described below in detail.

The manufacturing method includes a step of forming the dielectric layer on the first or second conductive member 1 or 2 using the dielectric material; a step of exposing the layer to light, a beam, or steam; and a step of forming pores in the dielectric layer.

In the exposing step, only predetermined regions of the dielectric layer may be subjected to exposure and other regions thereof may then be subjected to exposure under conditions different from those under which the predetermined regions are subjected to exposure. The following procedure is preferable: other regions thereof are masked with, for example, a stencil mask (a thin stainless sheet) in order to expose the predetermined regions only; the predetermined regions are subjected to exposure; and the mask is then removed. Furthermore, after the mask is removed, other regions thereof may be subjected to exposure. In this operation, the predetermined regions may be masked.

Alternatively, the following method may be used: a method including a step of forming a first dielectric layer on the first or second conductive member 1 or 2 using the dielectric material; a step of exposing the first dielectric layer to light, a beam, or steam; a step of partly removing the first dielectric layer to allow predetermined regions of the first dielectric layer to remain; a step of forming a second dielectric layer on the resulting first dielectric layer or the conductive member; and a step of forming pores in the first and second dielectric layers. The predetermined regions correspond to the variation sections 7, 8, 9, 12, 13, 19, 20, 21, 22, and 23 having dielectric constants different from those of other sections.

A more detailed procedure is described below.

A liquid dielectric material containing a metal organic compound described below is applied onto a substrate, which is then dried at, for example, about 80° C. in air, thereby increasing the viscosity of the dielectric material to form a dielectric layer containing the dielectric material. The substrate may be, but is not limited to, a conductive flat plate. The dielectric layer is subjected to exposure, whereby the metal organic compound is subjected to a cross-linking reaction. In order to promote the cross-linking reaction, the dielectric layer is heated at about 100° C. in air.

Organic components are removed from the dielectric layer by a supercritical extraction process using a supercritical fluid such as $CO_2$. The resulting dielectric layer is heated, for example, at about 200° C. for five to 30 minutes in air, whereby pores are formed in the dielectric layer. This step is referred to as a pore-forming step. If the substrate is not any conductive flat plate, a conductive flat sheet is joined to the dielectric layer.

The pores correspond to micro-portions of the dielectric layer from which the organic components are removed by the pore-forming step. In order to allow regions of the dielectric layer that correspond to the variation sections 7, 8, 9, 12, 13, 19, 20, 21, 22, or 23 to have low dielectric constant, these regions are controlled to have higher dielectric constant as compared with other regions. The dielectric constant of the dielectric layer may be controlled by varying the porosity of the dielectric layer continuously or stepwise so as to create the sine curve represented by reference numeral 16, the curve represented by reference numeral 17, or the polygonal line represented by reference numeral 18, as shown in FIGS. 11, 12, and 13, respectively.

In particular, the following procedure may be used: the dielectric layer is formed on the first or second conductive member 1 or 2; a stamp having projections for creating the sine curve represented by reference numeral 16, the curve represented by reference numeral 17, or the polygonal line represented by reference numeral 18 is pressed against the dielectric layer: the resulting dielectric layer is subjected to exposure; and another layer is then formed on the resulting dielectric layer. Alternatively, the following procedure may be used: the dielectric layer is formed on the first or second conductive member 1 or 2, subjected to exposure, and then machined so as to have projections for creating the sine curve represented by reference numeral 16, the curve represented by reference numeral 17, or the polygonal line represented by reference numeral 18; and another layer is then formed on the resulting dielectric layer.

In order to arrange the variation sections 20, 21, or 22 in such a manner that these sections are inclined to the thickness direction of the dielectric layer, a plurality of dielectric thin-films of which the porosities vary in their thickness direction may be stuck or light or beams may be obliquely applied to the dielectric layer. In particular, a dielectric thin-film is formed on the first or second conductive member 1 or 2 and predetermined regions of the dielectric thin-film that are used for forming the variation sections 20, 21, or 22 are subjected to exposure. Another dielectric thin-film is formed on the resulting former dielectric thin-film and regions of the latter dielectric thin-film that are used for forming the variation sections 20, 21, or 22 are subjected to exposure in such a manner that the above regions of the latter dielectric thin-film are misaligned with the exposed regions of the former dielectric thin-film. Another dielectric thin-film is formed on the resulting latter dielectric thin-film and then treated in the same manner as described above. This procedure is repeated, whereby the variation sections 20, 21, or 22 can be arranged in such a manner that they are inclined to the thickness direction of the dielectric layer. Alternatively, the following procedure may be used: the dielectric layer is formed on the first or second conductive member 1 or 2, predetermined regions of the dielectric layer that are used for forming the variation sections 20, 21, or 22 are removed, the resulting dielectric layer is subjected to exposure, and another dielectric layer is then formed on the exposed dielectric layer. Furthermore, the following procedure may be used: the dielectric layer is formed on the first or second conductive member 1 or 2 and light or a beam is obliquely applied to predetermined regions of the dielectric layer such that the variation sections 20, 21, or 22 are formed.

Examples of the metal organic compound contained in the dielectric material include metal alkoxide. The dielectric material may further contain a surfactant, which creates micelles regularly arranged in the dielectric layer. The dielectric layer is subjected to the pore-forming step, that is, a step of removing the surfactant from the dielectric layer, whereby pores are formed in such a manner that the pores are regularly arranged in the dielectric layer. This allows the porous dielectric layer to have high mechanical strength and good workability.

Examples of the dielectric material include a solution prepared as follows:

(1) A solution is prepared by mixing 2 g of a metal organic compound such as tetramethoxysilane ($Si(CH_3O)_4$) which is a kind of metal alkoxide, 10 g of ethanol, 2 g of butanol, 1 g of methyl 3-methoxypropionate, 1.2 g of water of which the pH is 3.

(2) The solution is subjected to a reaction at 60° C. for six hours and 0.05 percent by weight of IBCF, manufacture by Sanwa Chemical Co., Ltd., functioning as a photo-acid generator is added to the resulting solution, whereby a transparent solution is obtained.

(3) Subsequently, 10 ml of the transparent solution and 0.2 g of a surfactant such as hexadecyltrimethylammonium are mixed.

When the dielectric material contains the photo-acid generator that is photo-reactive, the dielectric layer can be partly removed with ease by the application of light or a beam.

In the dielectric layer heated at 100° C. in air to promote the cross-linking reaction, Si—OH bond derived from, for example, tetramethoxysilane is converted to Si—O bond, that is, a cross-linking reaction occurs.

When the dielectric layer is subjected to exposure, in order to allow the cross-linking reaction in the metal organic compound, the followings may be used: ultraviolet rays, electron beams, X-rays, ion beams, simple steam, steam containing oxide, steam containing a base compound, or steam containing the dielectric material. Portions having different porosities can be achieved in the pore-forming step by the use of any one of the above.

For the electron beams, the acceleration voltage is about 50 keV and the dose is 10 $\mu C/cm^2$. For the X-rays, the electron energy is 1 GeV. For the ion beams, the ion is $Be^{2+}$, the energy is 200 keV, and the ion dose is $1\times e^{13}/cm^2$ to $1\times e^{14}/cm^2$.

After the dielectric layer is partly irradiated with the ion beams or the like, non-irradiated portions of the dielectric layer have porosity higher than that of irradiated portions of the dielectric layer. Portions of the dielectric layer that have been irradiated with the ion beams have a relative dielectric constant of about 2.0, while other portions of the dielectric layer that have not been irradiated with the ion beams have a relative dielectric constant of about 1.5.

For the supercritical extraction process, the supercritical fluid is at least one selected from the group consisting of CO2, ethanol, methanol, water, ammonia, and fluorocarbon. An organic compound is extracted from the dielectric layer in such a manner that a pressure vessel containing the dielectric layer and the supercritical fluid is maintained under supercritical conditions: for example, a pressure of 15 MPa and a temperature of 80° C. In the pore-forming step, an organic solvent, such as alcohol, having high polarity may be used. The supercritical extraction process has an advantage in that the porosity of the dielectric layer can be readily controlled. This is because the supercritical fluid has low surface tension and can therefore enter micropores of the dielectric layer and the surfactant in the micropores can therefore be securely removed.

The present invention can be applied to antennas working at high frequencies higher than those of submillimeter waves.

What is claimed is:

1. A feed antenna comprising:

a pair of conductive members;

a dielectric waveguide placed therebetween;

a dielectric member that is placed between the conductive members and located close to the dielectric waveguide; and a plurality of dielectric binding sections located between the conductive members and directly connecting sides of the dielectric waveguide to the dielectric member defined between the conductive members, wherein one of the conductive members has a plurality of openings.

2. The feed antenna according to claim 1, further comprising a first section that is present between the first and second conductive members and located on the side of the dielectric waveguide opposite to the dielectric member and/or second sections that are each present between the dielectric binding sections, wherein the first section and/or the second sections contain a dielectric material having a dielectric constant less than that of the dielectric member.

3. The feed antenna according to claim 1, wherein the dielectric waveguide, the dielectric member, and the dielectric binding sections contain substantially the same dielectric material and have different porosities.

4. The feed antenna according to claim 1, wherein the dielectric waveguide has variation sections, arranged in the longitudinal direction of the dielectric waveguide, having dielectric constants different from those of other sections of the dielectric waveguide.

5. The feed antenna according to claim 1, wherein the dielectric constant of the dielectric waveguide varies in the longitudinal direction thereof.

6. The feed antenna according to claim 1, wherein the dielectric constant of the dielectric waveguide varies in the longitudinal direction thereof with the same periodicity as that of intervals at which the dielectric binding sections are arranged.

7. The feed antenna according to claim 1, wherein the dielectric binding sections are arranged at intervals equal to an integral multiple of the wavelength of feed signals transmitted to the dielectric waveguide.

8. The feed antenna according to claim 4, wherein the variation sections are inclined to the longitudinal direction of the dielectric waveguide.

9. The feed antenna according to claim 4, wherein an end portion of each variation section that is close to one of the dielectric binding sections is spaced from an end portion of the dielectric binding section that is close to the variation section in the longitudinal direction of the dielectric waveguide at a distance equal to one fourth of the wavelength of feed signals transmitted to the dielectric waveguide.

10. The feed antenna according to claim 4, wherein the dielectric member includes variation sections, arranged in the direction substantially perpendicularly to the dielectric waveguide, having dielectric constants different from those of other sections of the dielectric member.

11. The feed antenna according to claim 4, wherein the dielectric constant of the dielectric member varies in the direction substantially perpendicular to the dielectric waveguide.

12. The feed antenna according to claim 4, wherein the dielectric constant of the dielectric waveguide varies in the longitudinal direction thereof with the same periodicity as that of intervals at which the openings are arranged.

13. The feed antenna according to claim 4, wherein the openings of said one of the conductive members are arranged at intervals equal to an integral multiple of the wavelength of feed signals transmitted from the dielectric binding sections to the dielectric member.

14. The feed antenna according to claim 1, wherein the dielectric member includes variation sections, arranged in the direction substantially perpendicularly to the dielectric waveguide, having dielectric constants different from those of other sections of the dielectric member.

15. The feed antenna according to claim 1, wherein the dielectric constant of the dielectric member varies in the direction substantially perpendicular to the dielectric waveguide.

16. The feed antenna according to claim 1, wherein the dielectric constant of the dielectric waveguide varies in the longitudinal direction thereof with the same periodicity as that of intervals at which the openings are arranged.

17. The feed antenna according to claim 1, wherein the openings of said one of the conductive members are arranged at intervals equal to an integral multiple of the wavelength of feed signals transmitted from the dielectric binding sections to the dielectric member.

18. The feed antenna according to claim 13, wherein the variation sections of the dielectric member are inclined to the direction substantially perpendicular to the dielectric waveguide.

19. The feed antenna according to claim 13, wherein an end portion of each variation section of the dielectric member that is close to one of the openings is spaced from an end portion of the opening that is far from the variation section at a distance equal to one fourth of the wavelength of feed signals transmitted from the dielectric binding sections to the dielectric waveguide.

20. The feed antenna according to claim 13, wherein the dielectric waveguide includes a plurality of variation sections, arranged in the longitudinal direction of the dielectric waveguide, having dielectric constants different from those of other sections of the dielectric waveguide.

21. The feed antenna according to claim 13, wherein the dielectric constant of the dielectric waveguide varies in the longitudinal direction thereof.

22. The feed antenna according to claim 13, wherein the dielectric constant of the dielectric waveguide varies in the longitudinal direction thereof with the same periodicity as that of intervals at which the dielectric binding sections are arranged.

23. The feed antenna according to claim 13, wherein the dielectric binding sections are arranged at intervals equal to an integral multiple of the wavelength of feed signals transmitted to the dielectric waveguide.

* * * * *